US009288560B2

(12) United States Patent
Blonder

(10) Patent No.: US 9,288,560 B2
(45) Date of Patent: Mar. 15, 2016

(54) BRANCHED ACOUSTIC DEVICE

(71) Applicant: Greg E. Blonder, Summit, NJ (US)

(72) Inventor: Greg E. Blonder, Summit, NJ (US)

(73) Assignee: Genuine Ideas, LLC, Brookline, MA (US)

( * ) Notice: Subject to any disclaimer, the term of this patent is extended or adjusted under 35 U.S.C. 154(b) by 0 days.

(21) Appl. No.: 14/501,340

(22) Filed: Sep. 30, 2014

(65) Prior Publication Data

US 2015/0104055 A1 Apr. 16, 2015

Related U.S. Application Data

(60) Provisional application No. 61/890,543, filed on Oct. 14, 2013.

(51) Int. Cl.

| | |
|---|---|
| ***H04R 1/20*** | (2006.01) |
| ***H04R 1/02*** | (2006.01) |
| ***H04R 1/28*** | (2006.01) |
| ***H04R 1/34*** | (2006.01) |
| ***H04R 1/30*** | (2006.01) |

(52) U.S. Cl.

CPC .. *H04R 1/02* (2013.01); *H04R 1/20* (2013.01); *H04R 1/28* (2013.01); *H04R 1/2853* (2013.01); *H04R 1/2857* (2013.01); *H04R 1/30* (2013.01); *H04R 1/34* (2013.01); *H04R 2400/13* (2013.01)

(58) Field of Classification Search

CPC ..... H04R 1/02; H04R 1/26; H04R 1/28; H04R 1/2807; H04R 1/2811; H04R 1/2869; H04R 1/30; H04R 1/323; H04R 1/34; H04R 1/345; H04R 5/02; H04R 1/20; H04R 1/2853; G10K 11/02

USPC ..... 381/337, 338, 339, 340, 341, 347, 350, 381/351, 382; 181/148, 152, 153, 159, 160, 181/189, 196, 197, 198, 199

See application file for complete search history.

(56) References Cited

U.S. PATENT DOCUMENTS

| | | | | | |
|---|---|---|---|---|---|
| 4,616,731 | A | * | 10/1986 | Robinson | 181/148 |
| 5,082,084 | A | * | 1/1992 | Ye-Ming | 181/153 |
| 6,021,208 | A | * | 2/2000 | Kin-Lung | 381/338 |

* cited by examiner

*Primary Examiner* — Huyen D Le
(74) *Attorney, Agent, or Firm* — Lowenstein Sandler LLP

(57) ABSTRACT

An acoustic device configured for use with an audio source. The acoustic device includes a stem portion and multiple branches forming a cavity for passage of an audio signal when connected to an audio source. An array of multiple acoustic devices or nodes may be physically connected to form a tree-like structure for providing amplified sound in an aesthetically and tonally pleasing manner which fills its surrounding with sound. In view of the physical connectability of the individual nodes, an audio outputting device may be form which is easily modified, scaled, and/or re-configured to adjust its tonal properties and directionality.

14 Claims, 11 Drawing Sheets

BRANCHED ACOUSTIC DEVICE

CROSS-REFERENCE TO RELATED APPLICATION

This application claims the benefit of U.S. Provisional Application No. 61/890,543, filed Oct. 14, 2013, the entirety of which is hereby incorporated by reference herein.

TECHNICAL FIELD

Implementations of the present disclosure relate to the field of audio speakers and, more particularly, to a speaker cone configured in a tree-like configuration.

BACKGROUND

Sound, such as the human voice or a snapped twig, is produced by releasing mechanical energy from one localized spot into the surrounding medium, such as air. This released energy creates a pressure change around its source, forcing air into mechanical motion. Eventually, these mechanically induced sound waves expand and propagate through the air to the listener.

Over centuries, instrument designers have discovered that terminating the end of an instrument (e.g., a trombone or bugle) with a flared cone increases the instrument's loudness and enhances the purity of the instrument's tone. Similar cones are essential parts of mechanical record players, such as the phonograph 101 of FIG. 1A. A cone shaped component may also act as a mechanical sound amplifier for electromagnetic stadium speakers, such as the exemplary speaker 102 of FIG. 1A (shown in a side and perspective view). A person may even improvise a crude "megaphone" by cupping both hands around their lips to "throw" or project their voice a longer distance.

Acoustic cones have three main functions. First, by gradually expanding the localized source of acoustic energy, a more gentle transition prevents sound from reflecting backwards from the abrupt interface between the source and the air. The cone is the acoustic equivalent of electrical impedance matching, and can increase sound output by a factor of ten or more. Second, in some cases, reflected sound waves re-enter the sound generator, causing the generator to produce distorted or corrupted signals. The fewer back reflections, the purer the sound. Third, the cone may collimate sound into the forward direction, increasing the forward volume levels and allowing the sound to be aimed at listeners in the distance.

In a conventional acoustic cone, such as the "morning glory" shaped cone 101 attached to the needle assembly of a mechanical record player shown in FIG. 1A, there is a single cavity from the narrow to wide end. The cone diameter smoothly increases as the distance from the sound source increases. As illustrated schematically by the density of dots in 150 of FIG. 1B representing a gradient of the intensity of the sound pressure, the sound pressure in a cone decreases away from the smaller end 151 near the source, while simultaneously broadening in area.

Often, the relationship follows a logarithmic curve. This curve is known to optimally reduce reflections back into the record needle assembly, while not over-emphasizing any one frequency. This latter characteristic in critical for an acoustic cone intended to amplify a wide frequency range acoustic source, such a music. A cone with a uniform diameter (e.g., an organ pipe) resonates and tends to favor a single note.

However, such cones are not ideal solutions since they are large and often heavy. In addition, conventional cones tend to be directional, so listeners not facing the lip of the cone hear quieter and somewhat distorted sound images. Also, traditional cones are not easily adjusted to adapt their acoustic properties to match or compensate for deficiencies in the sound source. Furthermore, conventional cones are visually intrusive, such that the cone in current speakers is typically hidden inside a console (e.g., a plastic or wooden console) or a speaker enclosure (e.g., a rectangular speaker enclosure).

BRIEF DESCRIPTION OF THE DRAWINGS

The accompanying drawings are included to provide a further understanding of the present invention. These drawings are incorporated in and constitute a part of this specification, illustrate one or more implementations of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary implementations of the present invention and illustrate various objects and features thereof.

DETAILED DESCRIPTION

The present disclosure relates to an acoustic device configured for use with an audio source (e.g., an electromagnetic speaker). The acoustic device according to implementations of the present disclosure produces a pleasing tonal quality, amplifies sound (e.g., by more than 10 dB), uniformly fills its surrounding with sound, and can be easily modified, scaled, and/or re-configured to adjust its tonal properties and directionality.

According to implementations of the present disclosure, the acoustic device (also referred to as a "node") provides a cavity for the passage of an audio signal. In an implementation, the acoustic device or node may be configured as a cone.

Figure 1A:
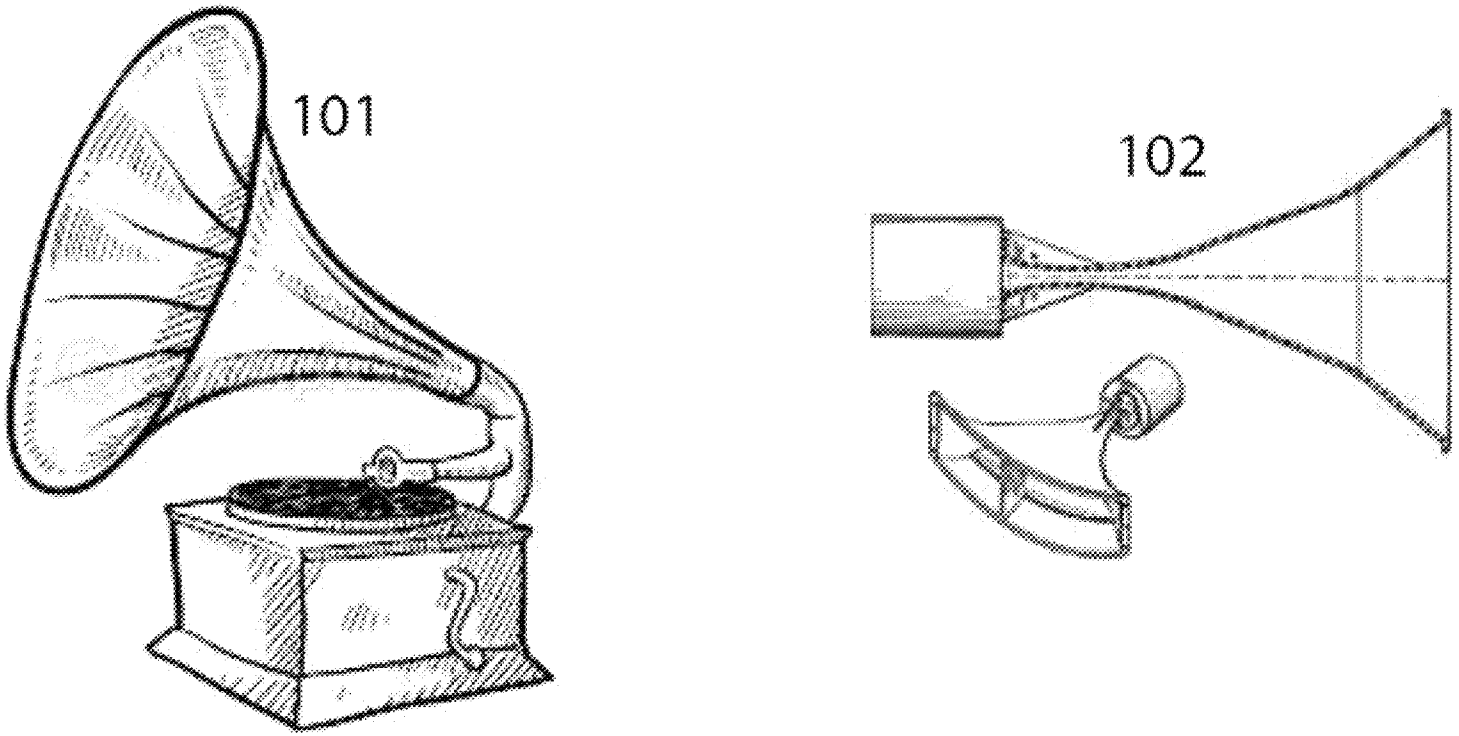
PRIOR ART FIGURE 1A
FIG. 1A illustrates a prior art audio amplification devices.
Figure 1B:
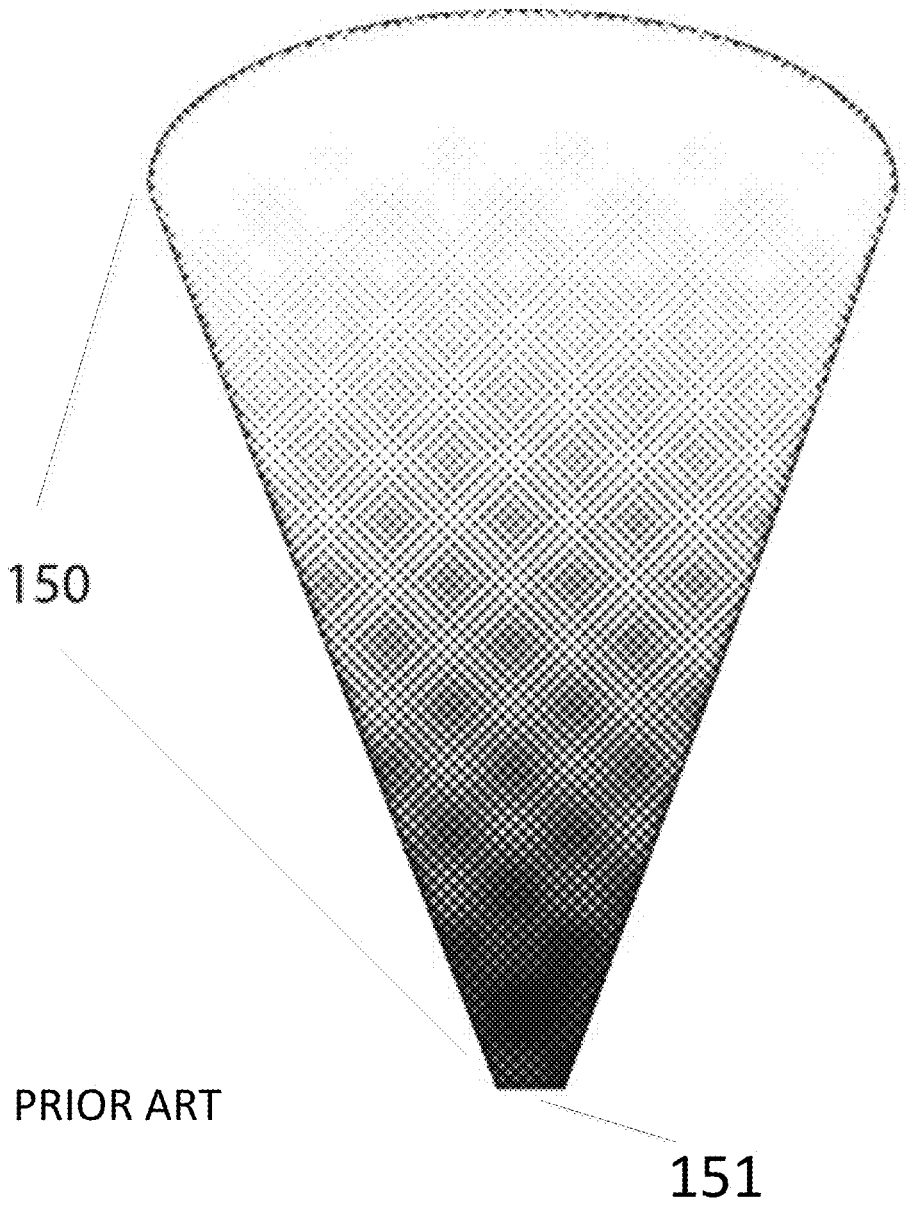
FIG. 1B illustrates a conventional sound pressure density gradient in a cone.
Figure 2A:
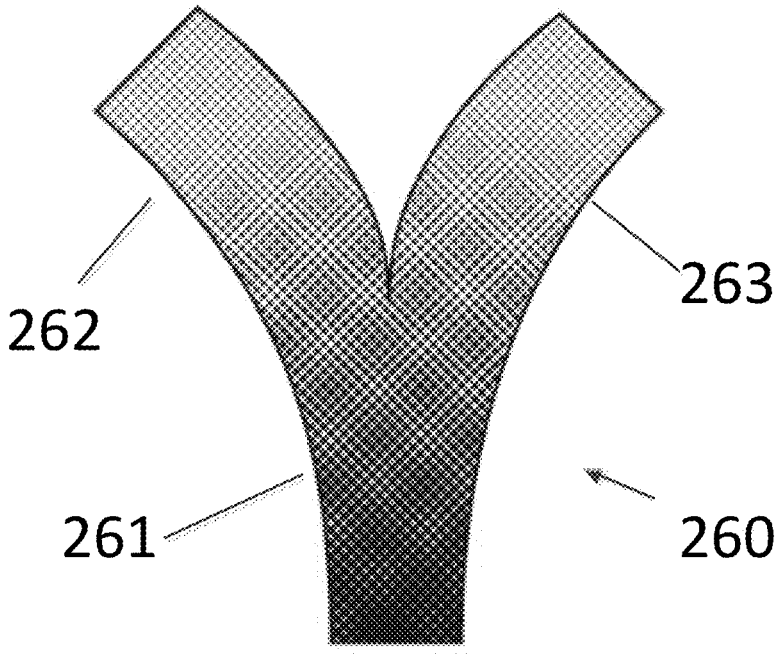
FIG. 2A illustrates an exemplary acoustic device, according to implementations of the present disclosure.
Figure 6:
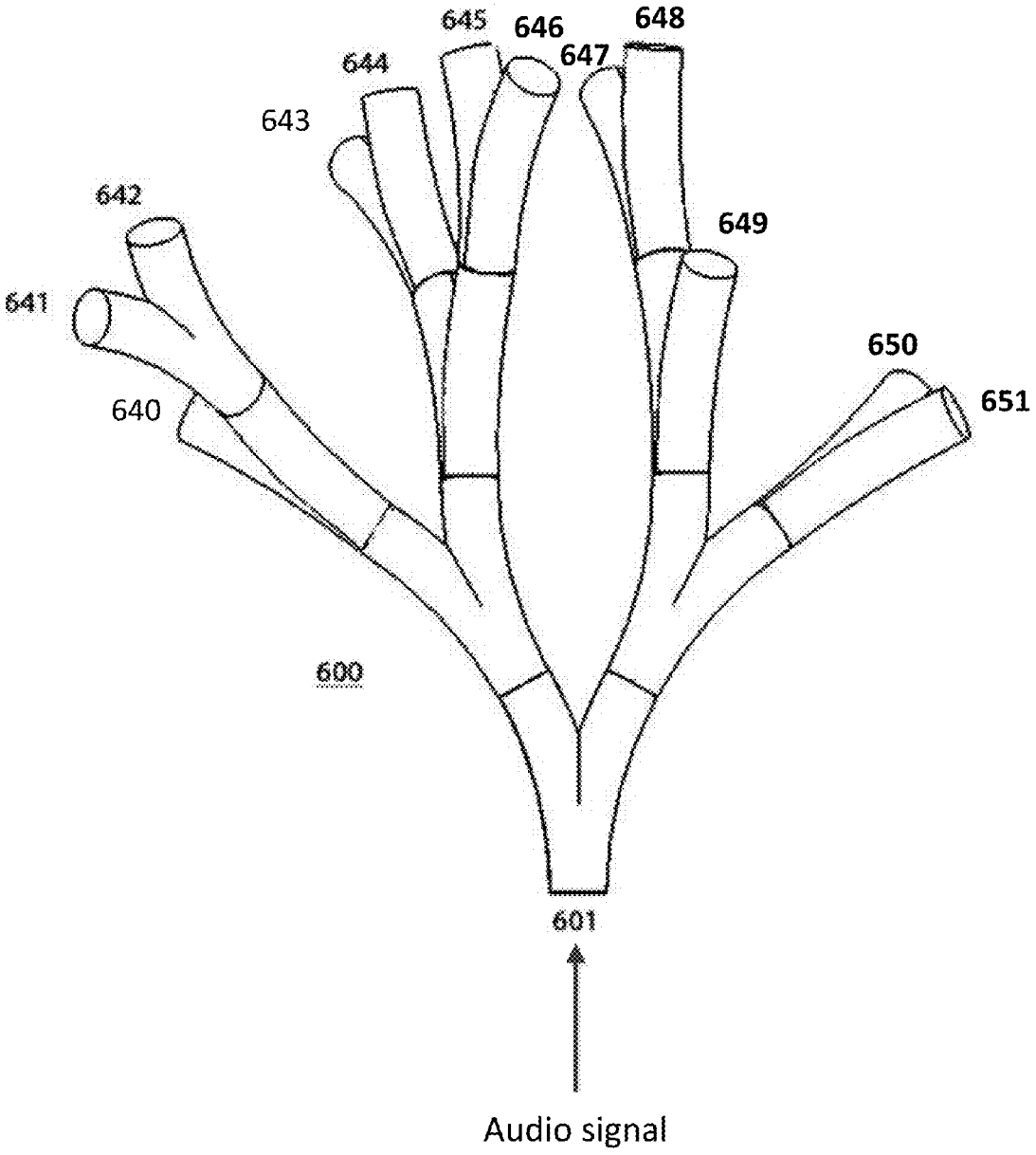
FIG. 6 illustrates an exemplary acoustic device including an array of multiple interconnected nodes, according to implementations of the present disclosure.

In an implementation, multiple nodes may be physically interconnected and configured in a tree-like arrangement. As shown in FIG. 2A, a node 260 reduces the sound pressure by an amount (e.g., a factor of two or three), while simultaneously redirecting the audio emission direction slightly away from an audio source (not shown). The acoustic cone device accomplishes this division by having a stem portion 261 of area "X", and gradually morphing the stem portion 261 into one or more arched pipes or branches 262 and 263. In an implementation, the one or more branches 262, 263 extend from the stem portion 261 and have an area equal or substantially equal to the area of the stem portion 261 (e.g., branches 262 and 263 each also have an area "X"). By cascading or interconnecting multiple individual nodes (as shown in FIG. 6), the sound pressure is sequentially divided and widened in new directions. Advantageously, the acoustic cone device provides for an adaptable, scalable and lightweight sound emission component for use with a sound producing element (e.g., an audio source).

In an implementation, each branch of a node may be of different lengths or of a same length. In an implementation, since each node in an array of nodes occupies a unique position and total length, the array of branches of a node does not strongly favor a single frequency like a single organ pipe. In an implementation, the acoustic cone device may include multiple nodes having one or more of the same characteristics (i.e., a same configuration, arrangement, number and position of branches, length of branches, length of stem portion, etc.) assembled in a symmetric array in order to emphasize certain frequencies.

In an implementation, the acoustic cone device may include an array having multiple nodes of different lengths and multiple nodes of identical length and/or position. According to implementations of the present disclosure, the acoustic cone device may include an array of nodes in any configuration in order to produce any desired frequency signature which is adjustable by a user upon re-configuration or re-positioning of the branches of the array.

Figure 2B:
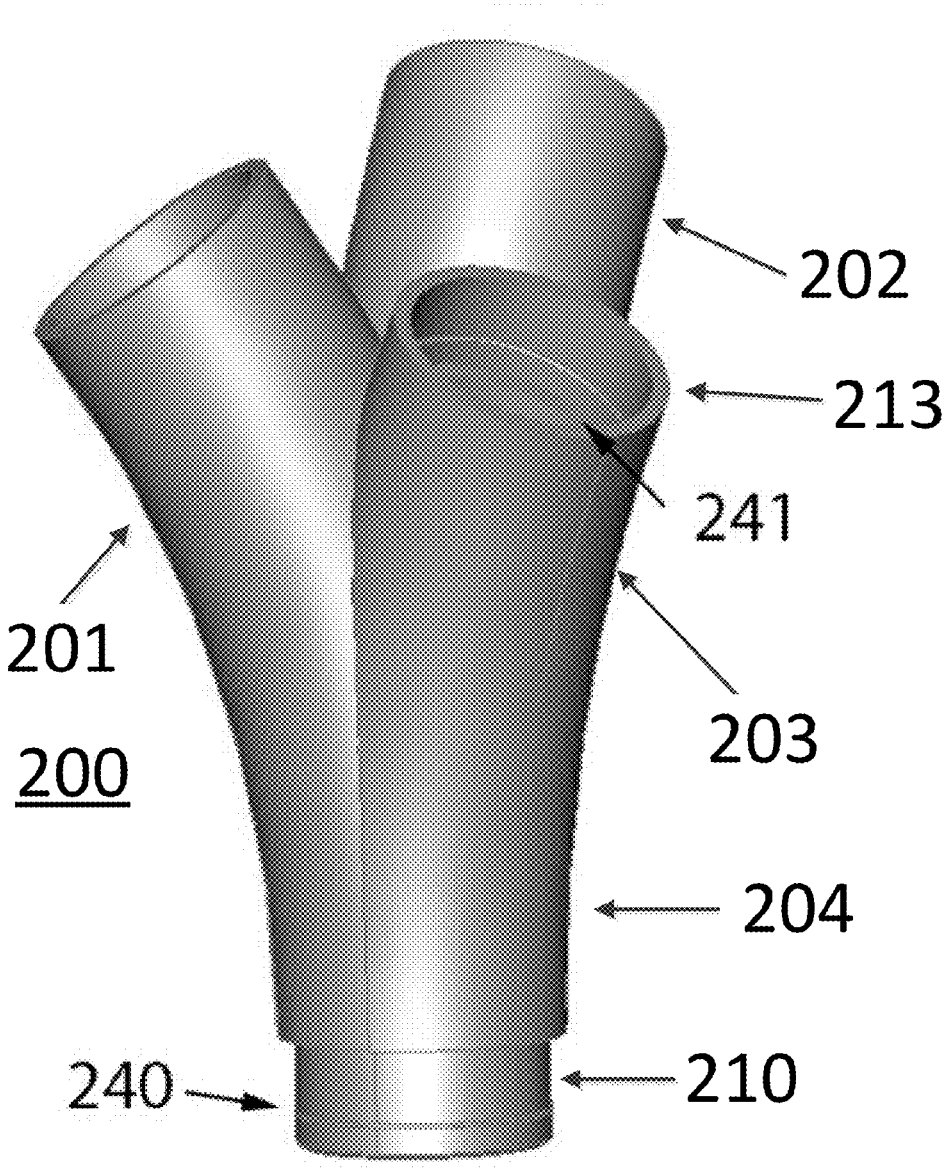
FIG. 2B illustrates an exemplary acoustic device, according to implementations of the present disclosure.

FIG. 2B illustrates a three branch node 200, wherein each branch 201, 202 and 203 is curved and their intersections smoothly mesh and extend from a stem portion 204. According to an implementation, each branch (e.g., branch 201, branch 202, and branch 203) may be of a different total length or multiple branches may have the same length.

Figure 3:
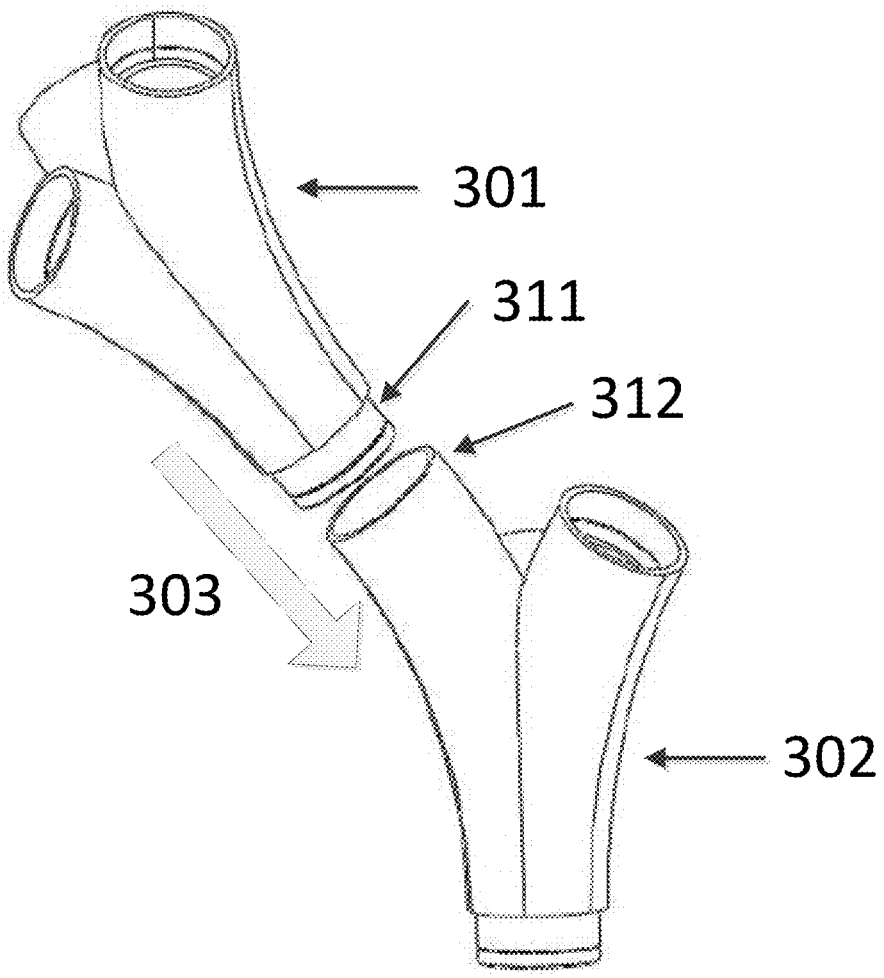
FIG. 3 illustrates an exemplary acoustic device including multiple nodes for connection, according to implementations of the present disclosure.

In an implementation, a node (e.g., node 200) may be configured for physical attachment or connection with one or more other nodes. Multiple nodes may be mechanically attached and linked together by any standard means known in the art. For example, as shown in FIG. 2B, node 200 includes a first end 210 having a boss containing a small annular ring 240. One or more of the branches (e.g., branch 201, branch 202, branch 203) may have a distal end (e.g., end 213 of branch 203) having a matching recess with an annular notch 241 configured to mate and engage with a corresponding end and annular ring of another node. In an implementation, the two ends of respective nodes are configured to physically connect (e.g., snap, mate, interconnect, attach, join, link, etc.) with each other for scaling the acoustic cone device. As shown in FIG. 3, independent nodes 301 and 302 are configured to connect to one another via an application of a connecting action, as illustrated by the connecting action arrow 303 in FIG. 3. Advantageously, the acoustic cone device is configured to allow each node (e.g., node 301 and node 302) to be firmly attached, yet rotated about the joint formed at the connection of the node pair at ends 311 and 312. In an implementation, rotation about the joint adjusts a direction of the sound emission of sound passing through a cavity formed by the connected nodes 301 and 302, as well as the aesthetic appearance. It is noted that any suitable connection may be employed, such as, for example, threaded joints, glued joints, slotted joints, magnetic latching, etc.

Figure 4:
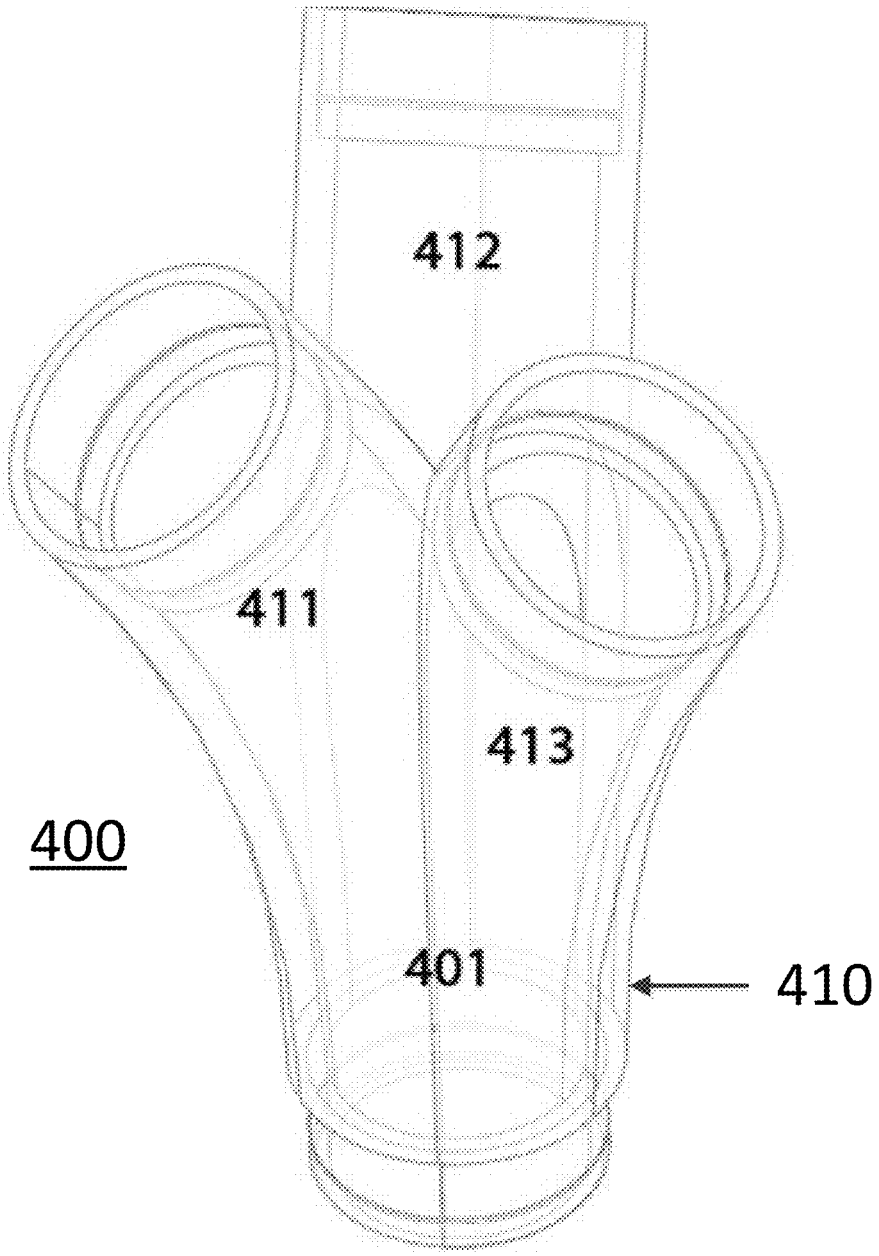
FIG. 4 illustrates an x-ray perspective view of an exemplary acoustic device, according to implementations of the present disclosure.

FIG. 4 illustrates an "x-ray" view of an exemplary node 200. As shown, node 400 includes an internal cavity 401 configured to smoothly expand from a stem portion 410 and merge into distal cavity portions of branches 411, 412, and 413. In an implementation, an end of stem portion 410 of node 400 is configured to attach to another component (e.g., an audio source configured to producing sound or another node configured to pass an audio signal). The cavity 401 of node 400 is configured to pass the audio signal there through to another node or as an audio output. In an implementation, if node 400 is a terminal node (i.e., a node positioned last or outermost relative to an audio source), the audio signal passes through and out of branches 411, 412 and 413 to produce an output audio signal for consumption by a listener.

Figure 5:
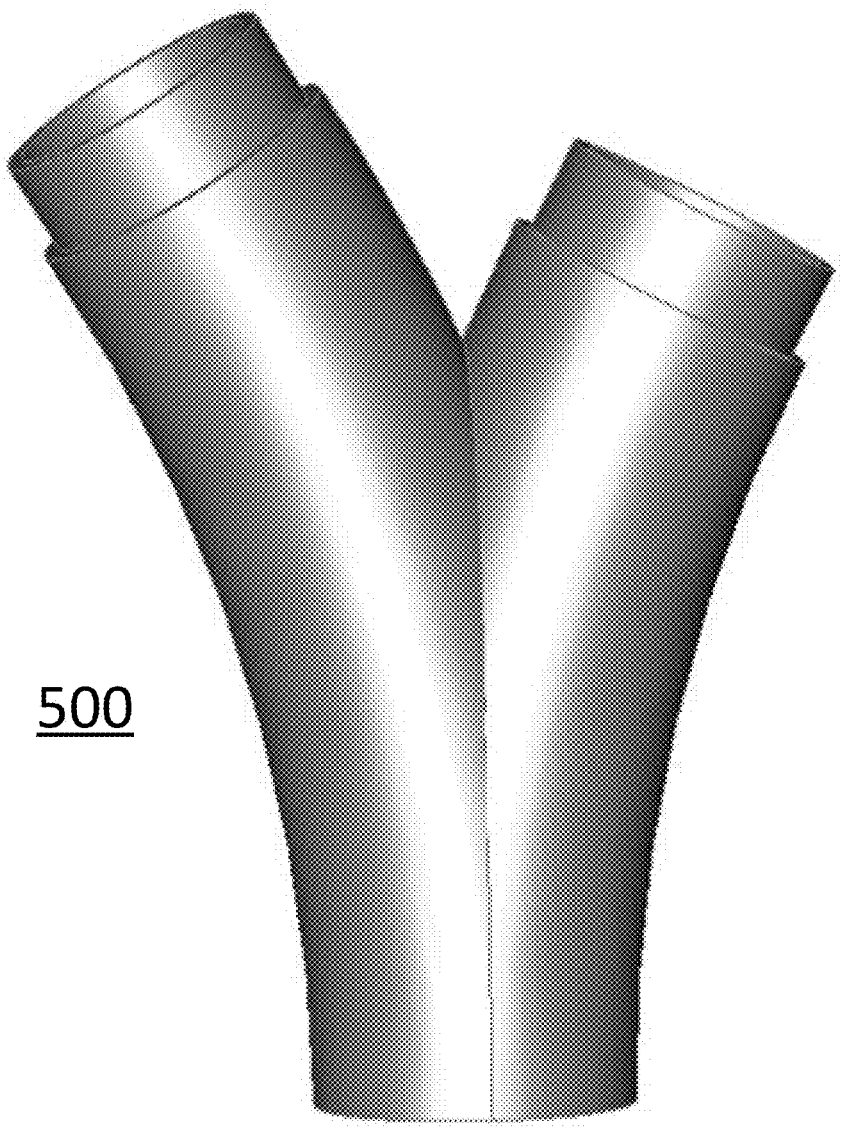
FIG. 5 illustrates an exemplary acoustic device, according to implementations of the present disclosure.

FIG. 5 illustrates a two branch node 500 configured for assembly into an array of nodes of an acoustic device as shown in FIG. 6, according to implementations of the present disclosure. In this implementation, an audio signal (e.g., sound) enters the array of interconnected nodes 600 at an opening of end 601, divides along a length of array 600, and emerges at openings of distal branches 640-651. In one implementation, the entire tree of nodes is constructed from identical molded parts, which facilitates stacking of nodes into an array and reduces the number of unique node parts in manufacture. It is to be appreciated that the branch diameters of each node may all vary, which would then fix the order and shape of the final assembled array.

Figure 7:
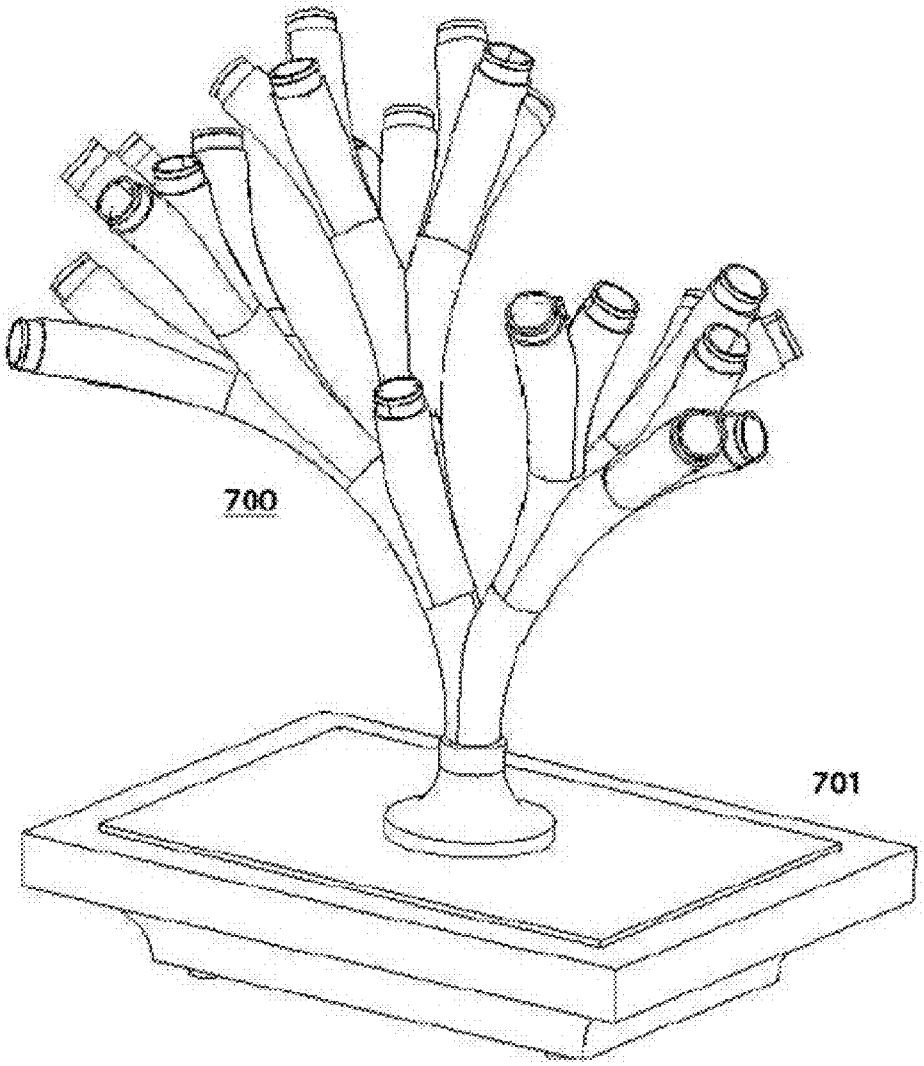
FIG. 7 illustrates an exemplary acoustic device including an array of multiple interconnected nodes physically connected to a base, according to implementations of the present disclosure.

FIG. 7 illustrates an array of interconnected nodes 700 including multiple two and three branch nodes attached to an audio source 701. As may be appreciated, the arrangement of nodes and base 701 presents the appearance of a bonsai tree, and thus is an attractive addition to a room.

Figure 8:
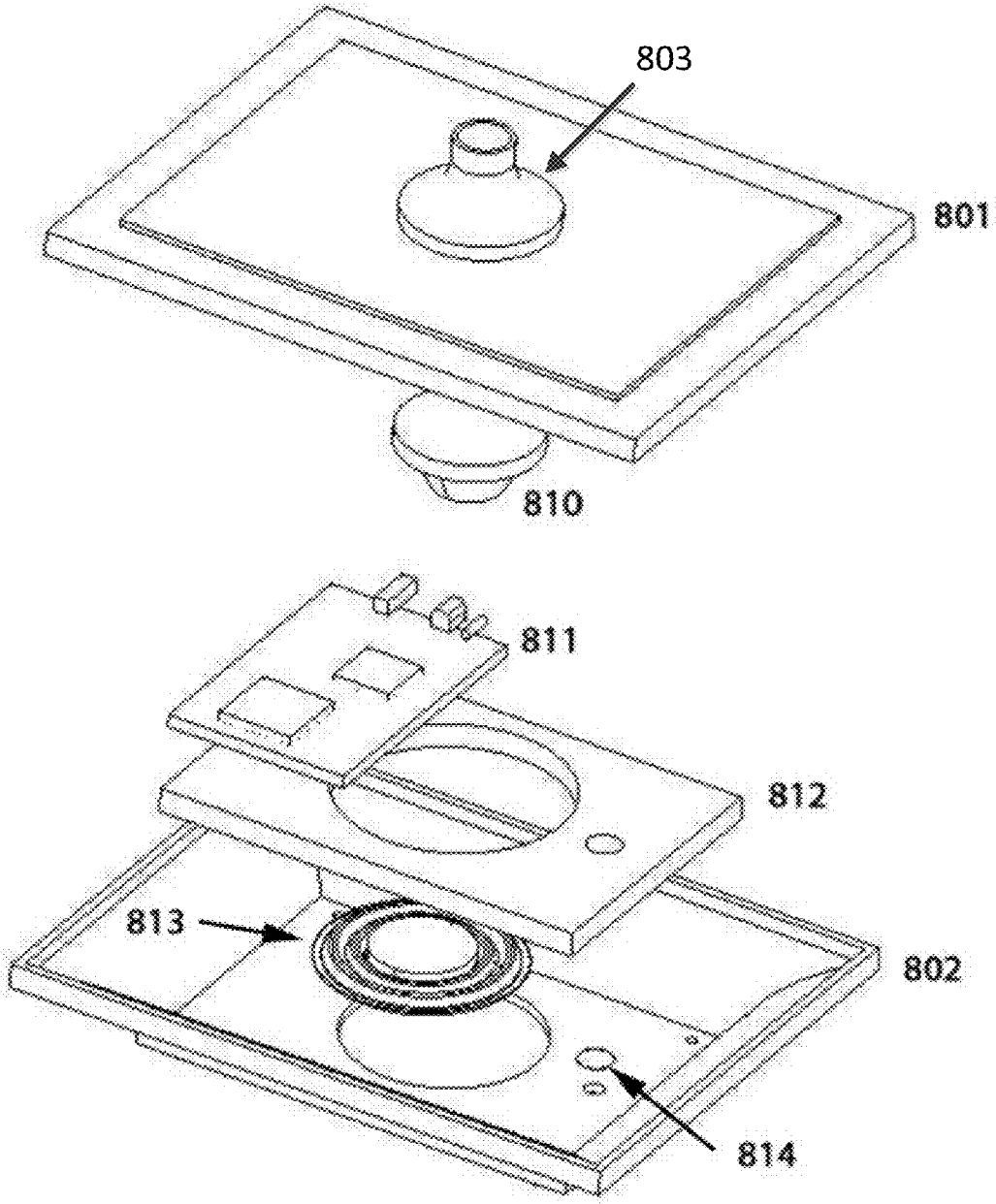
FIG. 8 illustrates an exploded view of an exemplary audio source base, according to implementations of the present disclosure.

FIG. 8 illustrates an exploded view of an exemplary audio source configured as a base or platform capable of generating an audio signal (e.g., base 701 of FIG. 7) having at least one mating component (e.g., mating component 803) for attachment with one or more nodes. The exemplary audio source may include two halves 801 and 802. The base may include a speaker 810, an electronics board 811 containing an amplifier circuit and optional illumination lights, a weight 812 for stability and prevention of vibrations while playing, an optional mass resonator 813 to extend the bass response of the speaker, an optional vent 814 to control the frequency response of the cavity inside the sealed base. Additional features and/or components of the base are not shown, such as, for example, a cord for power and audio signal, or a battery and wireless connection. As known in the art, the amplifier may be configured with an electronic pre-distortion circuit, such that any distortions from the speaker enclosure, the nodes or the speaker itself, are minimized.

Conventional small speaker cabinets rarely exhibit a flat acoustic frequency response. Typically, the amp or internal volume resonances overemphasize some frequency bands. According to implementations of the present disclosure, a number, length, and arrangement of nodes may be selected to form a resulting acoustic cone-shaped device configured to reduce unwanted resonances. In addition, a distal end of the "tree" (e.g., acoustic device 600 of FIG. 6) is configured to effectively spread sound throughout a hemispherical region, while taking up a reduced amount of physical space.

Figure 9:
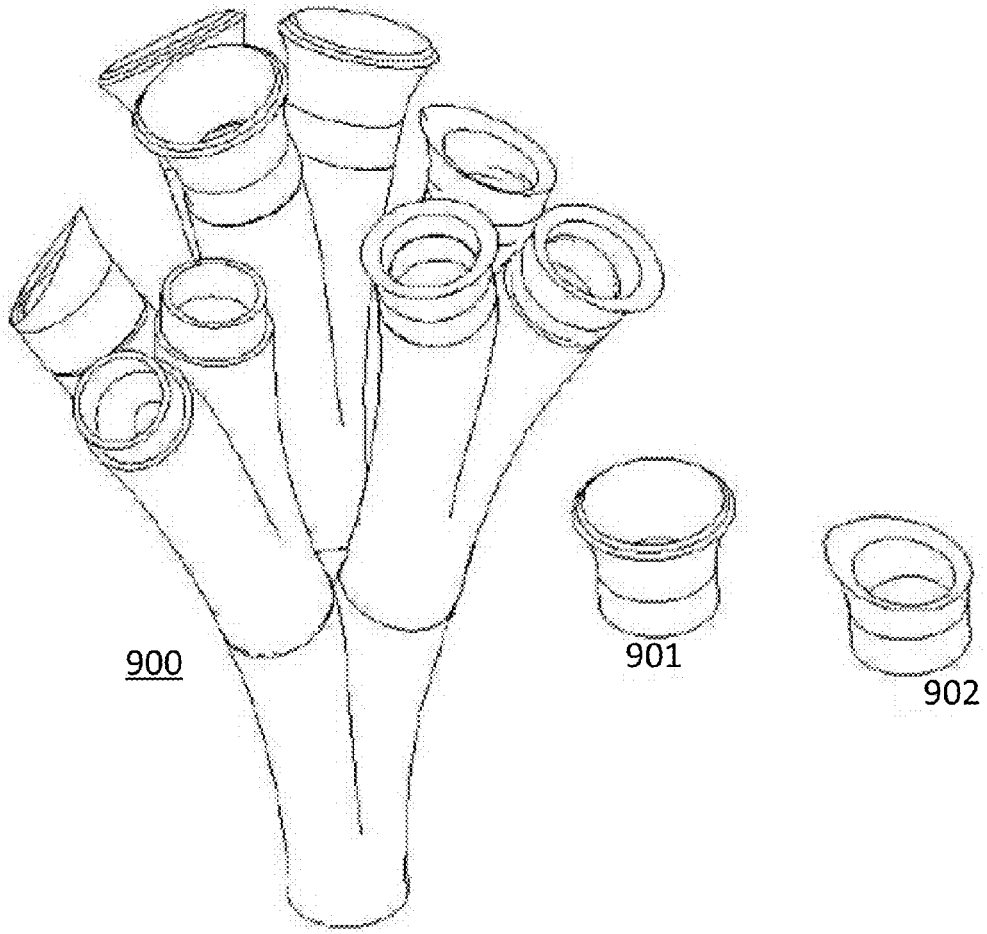
FIG. 9 illustrates exemplary end caps attachable to distal ends of one or more nodes of an exemplary acoustic device, according to implementations of the present disclosure.

FIG. 9 illustrates multiple exemplary end-caps 901, 902 for attachment to a distal end of a node assembly 900, according to implementations of the present disclosure. In operation, sound pressures are reduced via the sequential division of sound energy at each node, a small amount of reflection may occur from the distal ends to the surrounding air. Small, bell-shaped rings 901 and 902 may be attached to the distal ends of a node assembly 900 to more smoothly transition the sound output from the last branches. According to implementations of the present disclosure, any suitable design for the end-caps (e.g., end-caps 901, 902) may be employed, such that the transition of the sound output by the acoustic device (e.g., device 900).

It will be appreciated that other variations on the implementations of the present disclosure are within the scope of this invention. For example, a portable phone can replace the speaker in the base. In an implementation, the acoustic output from an audio producing element (e.g., a mobile audio device such as an Apple iPhone® or iTouch®) that generates an audio signal may be placed in a base or in communicative connection with the base. This output would be directed into the first node of the array, fore example, into 803 of FIG. 8. In an exemplary arrangement, an acoustic device may include any number of nodes (e.g., 15 or more nodes), wherein the acoustic device amplifies sound by more than 15 dB.

It is noted that while the nodes are shown as having circular portions (e.g., stem portion, branches), they may be other suitable shapes, such as, for example, ellipses or hexagons. It is further noted that the branches may be fabricated from any suitable material, such as, for example, plastic, metal, ceramic, etc.

What is claimed is:

1. An acoustic node comprising:

a stem portion comprising a first open end configured to physically connect to an audio source configured to produce an audio signal; and a first plurality of branches comprising a first branch extending from the stem portion to form a cavity configured to pass the audio signal, wherein at least one of the first plurality of branches comprises an end configured to physically connect with a second acoustic node comprising a second stem portion and a second plurality of branches extending from the second stem portion.

2. The acoustic node of claim 1, wherein the plurality of branches are configured to sequentially divide a sound pressure associated with the audio signal.

3. The acoustic node of claim 1, wherein the first plurality of branches are configured to redirect and output the audio signal.

4. The acoustic node of claim 1, wherein a second end of the first branch is configured to physically connect with an end cap configured to reduce reflection associated with the audio signal.

5. The acoustic node of claim 1, wherein the stem portion and the first plurality of branches comprise a same area.

6. The acoustic node of claim 1, wherein at least two of the first plurality of branches are a different length.

7. A device comprising:

a base comprising:

a mating component, and an audio source configured to generate an audio signal; and a plurality of physically connectable acoustic nodes configured to provide a cavity for passage of the audio signal, the plurality of physically connectable acoustic nodes comprising a first acoustic node comprising:

a stem portion configured to physically connect with the mating component of the base; and a first plurality of branches each comprising an end configured to physically connect with a second acoustic node of the plurality of acoustic nodes, wherein the second acoustic node comprises a second stem portion and a second plurality of branches extending from the second stem portion.

8. The device of claim 7, wherein the stem portion and the first plurality of branches are circularly shaped.

9. The device of claim 7, wherein each of the plurality of physically connectable acoustic nodes are of a same length.

10. The device of claim 7, wherein each of the plurality of physically connectable acoustic nodes are of different lengths.

11. The device of claim 7, wherein each of the plurality of physically connectable acoustic nodes comprises a same number of branches.

12. The device of claim 7, wherein upon physical connection, the plurality of physically connected acoustic nodes form a tree-shaped structure.

13. The device of claim 7, wherein upon physical connection, the plurality of physically connected acoustic nodes comprise one or more outermost acoustic nodes, wherein each of the one or more outermost acoustic nodes comprises at least one branch comprising an end configured to physically connect with an end cap configured to reduce reflection associated with the audio signal.

14. The device of claim 7, wherein the stem portion and the first plurality of branches comprise a same area.

* * * * *